US005265973A

United States Patent [19]

Badstieber

[11] Patent Number: 5,265,973

[45] Date of Patent: Nov. 30, 1993

[54] DEVICE FOR CONNECTING ACCESSORY PARTS TO FORMWORK PANELS

[75] Inventor: Johann Badstieber, Rutesheim, Fed. Rep. of Germany

[73] Assignee: Josef Maier, Steinach, Fed. Rep. of Germany

[21] Appl. No.: 679,038

[22] PCT Filed: Oct. 23, 1989

[86] PCT No.: PCT/DE89/00675

§ 371 Date: May 13, 1991

§ 102(e) Date: May 13, 1991

[87] PCT Pub. No.: WO90/05226

PCT Pub. Date: May 17, 1990

[30] Foreign Application Priority Data

Nov. 12, 1988 [DE] Fed. Rep. of Germany ..... 3838489

[51] Int. Cl.[5] ..... E04G 17/04

[52] U.S. Cl. ..... 403/374; 403/387; 403/398; 403/399

[58] Field of Search ..... 403/49, 387, 398, 399, 403/388, 190, 235, 374

[56] References Cited

U.S. PATENT DOCUMENTS

| | | | |
|---|---|---|---|
| 3,004,636 | 10/1961 | Shane | 52/239 |
| 3,330,583 | 7/1967 | Kennedy | 287/189.36 |
| 4,430,019 | 2/1984 | D'Alessio | 403/409 |
| 4,439,052 | 3/1984 | Wallther | 403/49 |
| 4,786,204 | 11/1988 | Mayeda | 403/398 X |

FOREIGN PATENT DOCUMENTS

| | | |
|---|---|---|
| 0049096 | 4/1982 | European Pat. Off. . |
| 3432140 | 3/1986 | Fed. Rep. of Germany . |
| 866489 | 7/1962 | France . |
| 8007127 | 10/1980 | France . |
| 2505913 | 11/1982 | France . |
| 1259048 | 9/1986 | Switzerland . |
| 1222347 | 2/1971 | United Kingdom . |

*Primary Examiner*—Randolph A. Reese
*Assistant Examiner*—Anthony Knight
*Attorney, Agent, or Firm*—Darby & Darby

[57] ABSTRACT

A device (1) serves for connecting accessory parts (2) to formwork panels, compensating members or suchlike formwork members having stiffening webs or stiffening profiles (3) on their side averted form the forming surface. The device (1) has an essentially U-shaped cross section, the U-arms (4) having fastening locations (5), preferably bores, for the accessory parts (2) such as booms, adjustable props, platform brackets or the like, and in the position of use the U-crosspiece (6) butting and being drawn fast against a stiffening profile (3) and above all against a cross web (**3*b*) provided on this profile (3). At least one of the U-arms (4), preferably both U-arms (4), has an extension (7) passing over part of its length and beyond the U-crosspiece (6) on that side of the U-arms which faces the forming surface in the position of use, the extension being provided as protection against torsion and being adapted to be placed against the longitudinal side face (3*a*) of the stiffening profile (3) and against the transition from the rearward web (3*b*) to the longitudinal side face (3*a*). The U-crosspiece (6) of the device (1) has at least one recess or hole (8)—possibly even one open at the edge—for a fastening member to engage, preferably for the shank (9*a*) of a fastening member (9) to pass through. It is thereby possible for the device (1) to be anchored—in a torsion-proof position and in two orientations rotationally staggered through 90°—to a stiffening profile (3**), so that the forces and moments encountered can be transferred well (FIG. 1).

33 Claims, 3 Drawing Sheets

DEVICE FOR CONNECTING ACCESSORY PARTS TO FORMWORK PANELS

BACKGROUND OF THE INVENTION

The invention relates to a device for connecting accessory parts to formwork panels, compensating members and suchlike formwork members having stiffening webs or stiffening profiles on their side averted from the forming surface. The device has an essentially U-shaped cross section, the U-arms having fastening locations for the accessory parts such as booms or the like. In the position of use, the U-crosspiece butts against a stiffening profile of the formwork.

Formwork for circular constructions is known from German Patent Specification No. 33 33 619, in which a chain of ties adjustable in their length is provided on the girders shoring the forming surface. These ties engage the girders of the formwork panels by way of connecting pieces and have an approximately U-shaped cross section. These connecting pieces have the fastening locations for the individual ties in their U-arms averted from the formwork.

The connecting pieces require further coupling members for engaging the stiffening girders or stiffening profiles, these coupling members for their part being approximately U-shaped and embracing the stiffening girders. It is not possible for any accessory parts such as stays directed towards the base, brackets or the like, to be fastened with these connecting pieces because they remain firmly connected to the individual ties.

SUMMARY OF THE INVENTION

The object underlying the invention is to create a device of the kind mentioned at the outset, with which any accessory parts such as booms, brackets, stays and the like can be fastened to formwork panels quickly, simply and without any difficulty. It is to be possible for the stiffening webs or stiffening profiles to be oriented vertically or horizontally.

This seemingly contradictory object is accomplished in a device of the kind mentioned at the outset in that each of the U-arms has an extension passing over part of its length and beyond the U-crosspiece on that side of the U-arms which faces the forming surface in the position of use. The extensions are provided as protection against torsion and are adapted to be placed against the longitudinal side faces of the stiffening profile and against the edges or bend at the transition from a rearward web to the longitudinal side faces of the stiffening profile. The U-crosspiece of the device has at least one point of engagement, recess or hole for a shank of a fastening member to engage or pass through. The fastening member has a head or the like projecting radially beyond the shank at least to one side and is adapted to be inserted into the stiffening profile from the side averted from the forming surface, through an opening in the stiffening profile. The fastening member is adapted to be anchored or clamped to the stiffening profile with its head and has at the end averted from its head or suchlike anchorage a counter-stop for anchorage to the U-shaped device. The two extensions, which have lengths smaller than the overall lengths of the U-arms, form shoulders with the U-crosspiece and are situated beyond the neighboring region of the holes. In a seemingly inconsistent manner parts of the U-arms of the device of U-shaped cross section project beyond the U-crosspiece, but thereby permit torsion-proof coupling onto the stiffening profile with the aid of the fastening member. Therefore any parts can in turn be fastened to this device without any difficulty and without any additional measures for protection against torsion. Due to the two extensions of the U-arms, the protection against torsion is particularly effective and allows large forces and moments to be conducted into the stiffening girders.

Since the extensions run over only part of the length of the U-arms and form shoulders, the device can be fixed to the stiffening profiles also when it is turned through 90°, i.e., with U-arms running approximately at right angles to the longitudinal expanse of the stiffening profiles. Therefore these stiffening profiles can run both horizontally and vertically and the device according to the invention can be put to use for such formwork panels as are to be rotatable through 90° or have intersecting stiffening profiles while, in turn, always maintaining a constant, proper orientation. In the one fitting position, these two extensions of the U-arms may engage over the longitudinal sides of the stiffening profile and thus provide good and very secure protection against torsion in both conceivable directions of rotation, which permits the transfer of high forces and moments. In a position rotationally staggered through 90°, the shoulders of the shortened U-arms can both be placed against a common longitudinal side of a stiffening profile, which again provides protection against torsion and the possibility of transferring moments. The distance of the two extensions from one another and from the fastening member produces effective and torsion-proof anchorage of the device onto the stiffening profile because the device is secured or supported in position relative to the stiffening profile at at least three points.

A device for connecting accessory parts with profiles is known from U.S. Pat. No. 3,330,583. Here, approximately horizontal tubular girders are coupled to vertical columns in order to construct platforms, partitions or frameworks. The approximately U-shaped device is oriented with its two U-arms one above the other and with the U-crosspiece abutting the vertical girder. It also has an automatic lock and a protective element against torsion which is itself approximately U-shaped and is arranged at the level of the lower U-arm. Fastening of the device to a girder rotated through 90°, that is, a horizontal girder, is not possible without corresponding rotation of the device. This would be unsuitable for columns or the like which are inclined to the device.

It is advantageous for the device of the invention when the fastening member has a hammerhead which in one orientation is adapted to be inserted through an oblong hole in the cross web of the stiffening profile and in a rotated condition—e.g. through 90°—engages behind the edges of the oblong hole. This allows to the device and a stiffening profile provided with corresponding oblong openings to be coupled particularly quickly and effectively.

For protection against torsion by means of the shoulders on the shortened U-arms, it is favorable for the shoulders to be approximately steplike.

The shoulders between U-crosspiece and extensions of the U-arms may be adapted to be placed against the longitudinal side of the stiffening profile and so act as protection against torsion. The shoulder may be situated at that distance from the hole for the fastening member which the oblong hole or suchlike opening in the stiffening profile has from the beginning of the longitudinal web of this profile. It automatically follows from this that the means protecting against torsion of the device take effect in the two fitting positions rotationally staggered through 90°, because when fixed by the fastening member they butt against the longitudinal side of the stiffening profile.

The better the device is urged against a stiffening profile, the more effective is the protection against torsion. It may be appropriate for this purpose if the counter-stop serving for the fastening member and acting upon the U-crosspiece of the device is adapted to be braced against the latter. This counter-stop may engage the shank of the fastening member in a releasable manner. In this way, the counter-stop can also be affixed subsequently, when the fastening member and its head have been inserted through the opening in the stiffening profile and rotated.

A transverse slit through the shank of the fastening member at the end thereof averted from the head, and a wedge adapted to be inserted into the transverse slit, may be provided as the counter-stop. In the position of use, the transverse slit preferably extends right into the hole in the crosspiece of the device. Thereby a concrete solution is simply provided for being able to brace the counter-stop against the U-crosspiece of the device. The wedge only has to be driven in deep enough to exert pull on the shank and thereby also on the head of the fastening member and to urge the U-crosspiece of the device against the stiffening profile.

In order to minimize the length of the fastening member and thereby the overall size of the device, it is of advantage if in the position of use the transverse slit in the shank of the fastening member is disposed between the U-arms of the device on that side of the U-crosspiece which is averted from the forming surface. The U-arms of the device have openings at the level of the transverse slit for the anchoring wedge. The wedge can therefore be inserted through these openings in order to reach its position of use in the transverse slit of the shank of the fastening member.

A further expedient development of the device may consist in that the cross section of the transverse slit for the wedge is arranged on the shank of the fastening member so as to be rotated—preferably through 45°—relative to the hammerhead of the latter. The openings in the U-arms of the device are arranged so as to be staggered in such a way and/or extend laterally in such a way that the wedge passes at an angle from the one arm, through the anchoring slit of the fastening member, to the other opening. The wedge can therefore be driven in with a slanting fit in such a manner as to be held in its position of use by gravity. This not only makes fitting easier, but also counteracts any unintentional loosening.

A further advantageous development may consist in that the openings for the wedge in the U-arms of the device extend laterally in such a way or that so many openings are provided side by side that the wedge can be inserted from both sides at an angle to the surface of the U-arms, in at least two positions preferably rotationally staggered by 90°. This allows for the possibility of being able to apply the device to stiffening profiles in two positions varying by 90°, depending on whether these stiffening profiles run approximately vertically or horizontally. In each of these cases it can therefore be achieved that the wedge passes from top to bottom at an angle and not approximately horizontally or even from bottom to top.

The fastening locations for the releasable attachment of accessory parts may take the form of recesses, preferably holes, and be arranged on the U-arms of the device, in spaced relationship to the openings for the anchoring wedge. Mention is however made at this point that a nut may also be provided by way of a thread on the shank as a counter-stop, should the U-arms not offer sufficient room for the openings for the wedge on the one hand and for the fastening locations on the other hand.

A fastening location may be provided on each U-arm and both fastening locations may preferably be of the same shape and correspond in position, in particular taking the form of bores for a bolt or the like. The latter can then traverse a portion of an accessory part engaging between the two U-arms and be anchored to the U-arms on both sides of this engaged portion of the accessory part.

The fastening member of the device is secured particularly simply and well if the surfaces of the head of the connecting bolt which face the inside of the U-cross web of the stiffening profile slant outwardly from the shank in accordance with a bead-like or channel-like depression of the U-cross web of the stiffening profile. This at the same time increases the rigidity of the stiffening profile, so that it lends itself all the better to the attachment of accessory parts by way of the device according to the invention.

It is expedient if the extensions of the U-arms are integral therewith. The U-crosspiece of the device may be fitted, particularly welded, between the U-arms and extensions thereof and its surface resting against the outer web of the stiffening profile in the position of use may appropriately be approximately flush with the non-extended area of the U-arms. This produces a rigid design, particularly of the U-shaped part of the device according to the invention.

Mention is made that the hole for the fastening member is appropriately a bore, because this can be made particularly simply and also allows a correspondingly simple round shank of the fastening member. The bolt-like fastening member may have between its shank of preferably round cross section and the angular surfaces arranged in a roof-shaped manner on the underside of its head a square area as protection against torsion, the square area serving to engage the recess in the cross web of the stiffening profile. This makes it easier for the transverse slit for the anchoring wedge to retain its position after the head of the fastening member has been inserted and fixed, and thus makes it easier for the wedge to be inserted at an angle from the side.

In order to save weight, the U-arms of the device may be slanted between their end faces and their edges averted from the crosspiece, the slants being beyond the openings for the anchoring wedge and the holes for fastening accessory parts.

The preceding features taken singly or severally, result in a device with which any accessory parts including adjustable props, platform brackets, climbing brackets, supporting jacks, base stays or booms, can be attached to framwork members having suitable stiffening webs and stiffening profiles. The device permits of being fitted in two positions preferably rotationally staggered by 90°. Consequently, the device together with its U-arms and fastening locations can in each case be oriented in such a way as is required to attach the accessory parts, regardless of whether the stiffening profiles of the formwork panels are for their part oriented vertically or horizontally. This device can also be arranged on floor formwork with corresponding stiffening profiles. An efficient and firm connection between the accessory parts and the formwork member is produced in every position of attachment, it being possible for not only forces but also moments to be transferred owing to the good protection against torsion.

BRIEF DESCRIPTION OF THE DRAWINGS

Preferred embodiments of the invention are described below in great detail with the aid of the accompanying drawings wherein.

DESCRIPTION OF THE PREFERRED EMBODIMENTS

Figure 1:
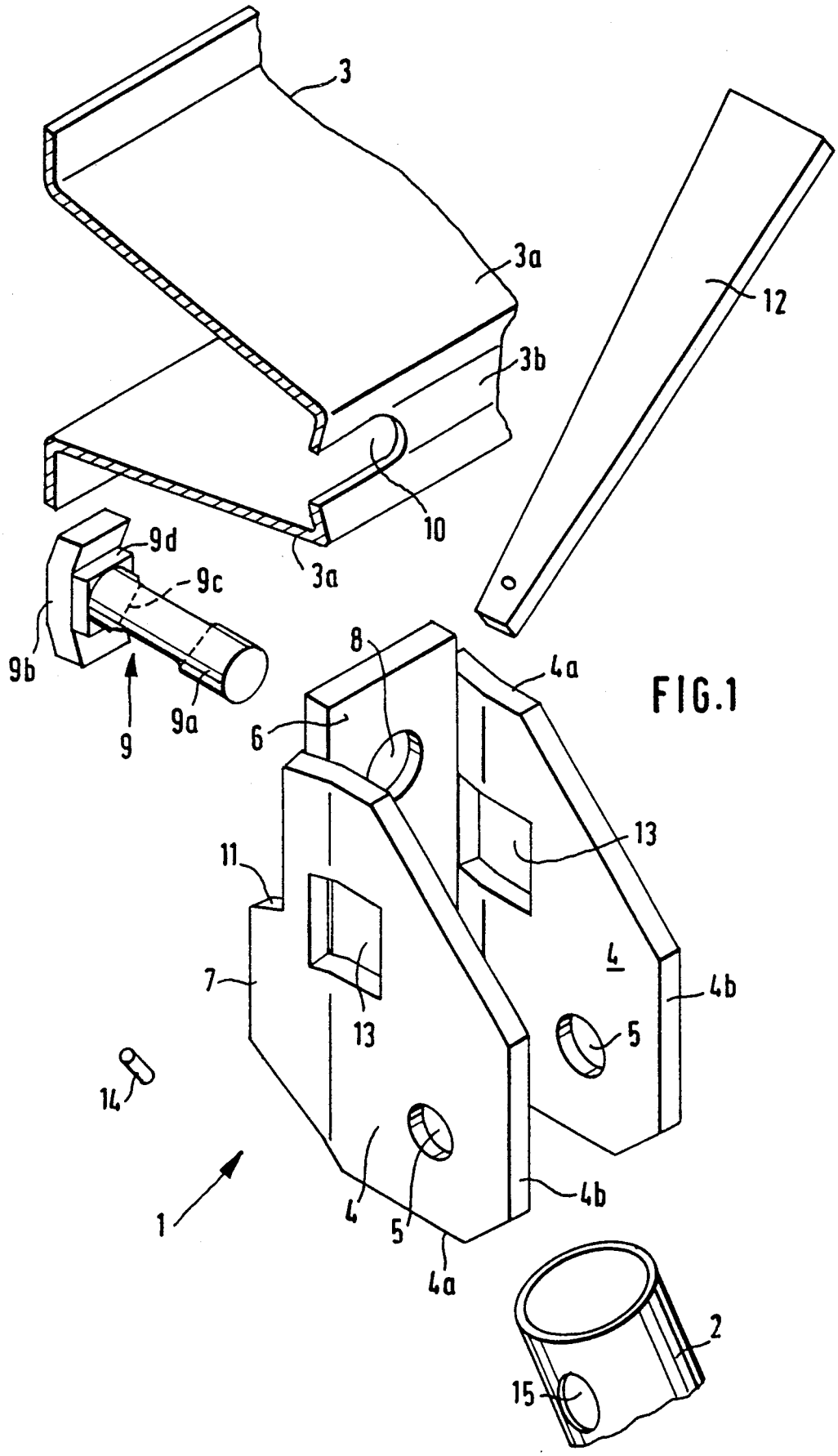
FIG. 1 is an exploded view of the device according to the invention before being fitted to a horizontally oriented stiffening profile of a vertical formwork panel and before having an accessory part, in this case an adjustable prop, attached to it.

A device designated altogether as 1 serves for connecting accessory parts, for instance an adjustable prop 2, to formwork panels, compensating members or suchlike formwork members which are not shown in any detail in the drawings and have stiffening webs or stiffening profiles 3 on their side averted from the forming surface.

Figure 5:
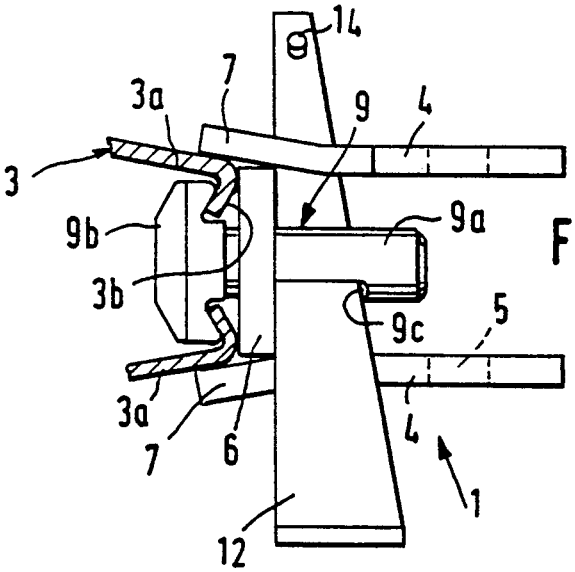
FIG. 5 is a top view of the device in the orientation of FIG. 4 and in a position in which the extensions of the U-arms of the device engage over the longitudinal side faces of the stiffening profile as protection against torsion.

It becomes clear by reference to FIG. 1 and FIG. 5 that the device 1 has an essentially U-shaped cross section and its U-arms 4 have fastening locations 5 for the accessory parts such as booms, adjustable props 2 or the like. In the position of use the U-crosspiece 6 butts against the stiffening profile 3 of the formwork, in accordance with FIGS. 3 and 5.

Figure 2:
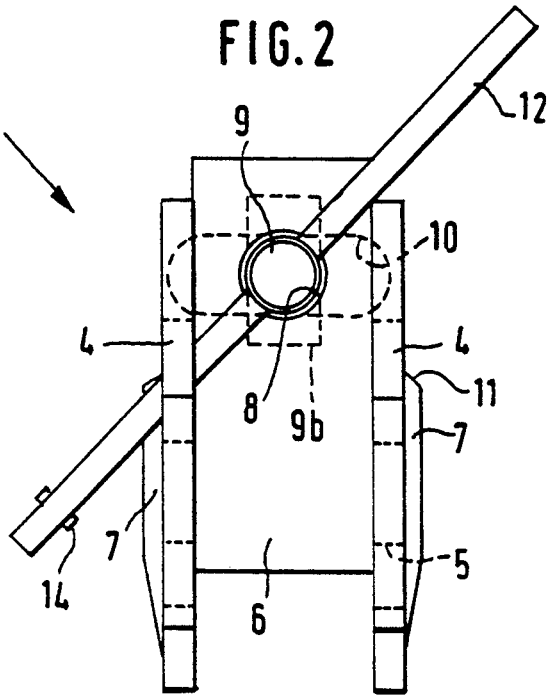
FIG. 2 is a rear view of the device in the fitted condition, the horizontal stiffening profile and the accessory part being omitted in the interest of clarity, but an oblong hole in the stiffening profile being indicated.
Figure 3:
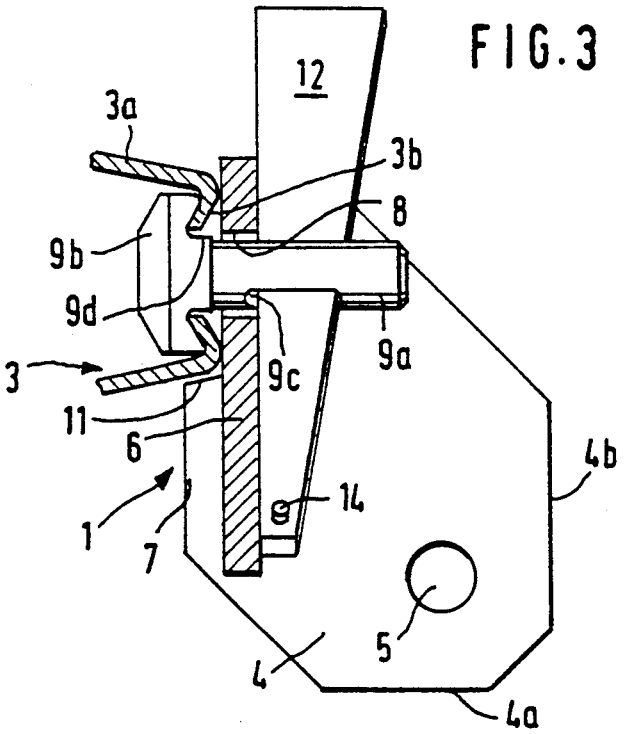
FIG. 3 is a section through the U-crosspiece of the device and through that area of a stiffening profile which is proximate to this device, as well as a view of a U-arm and the extension thereof serving as protection against torsion.
Figure 4:
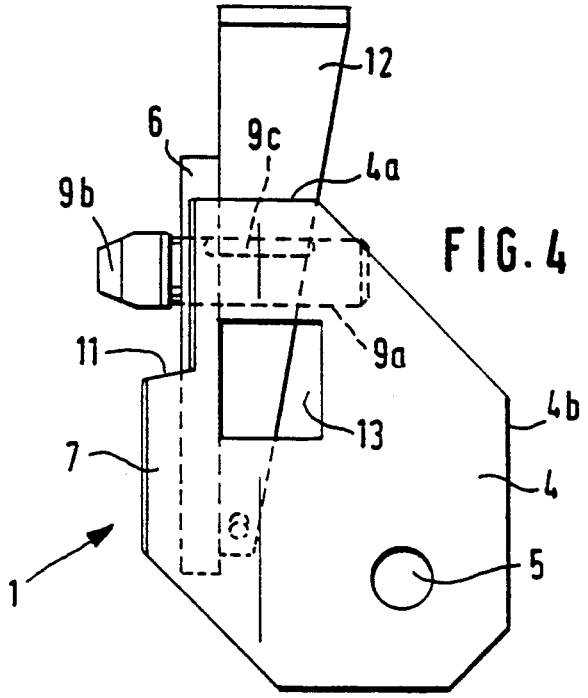
FIG. 4 is a view of the entire device in an orientation for engaging a vertical stiffening girder or stiffening profile.

In comparing FIGS. 2 and 3 on the one hand with FIGS. 4 and 5 on the other hand it is apparent that steps have been taken so that engagement can be made to a profile 3 by the device 1 in two different positions rotationally staggered by 90°, or that fixation to profiles 3 varying 90° in orientation is possible. At the same time, the device 1 is protected well against torsion relative to the profile 3, so that the forces and moments to be transferred can be conducted well.

This is achieved in that the U-arms 4 have an extension 7 in each case passing over part of their length and beyond the U-crosspiece 6 on that side of the U-arms which faces the forming surface in the position of use. The extensions 7 are provided as protection against torsion in both fitting positions. In accordance with FIGS. 3 and 5, these extensions 7 are adapted to be placed in two different ways against the longitudinal side face 3*a* of the stiffening profile 3 and against the edge or bend at the transition from a rearward web 3*b* to the longitudinal side face 3*a* of the stiffening profile 3.

The U-crosspiece 6 of the device 1 has a hole 8 for the passage of a shank 9*a* of a fastening member 9 also having a head 9*b* projecting radially beyond this shank 9*a* at least to one side, in the illustrated embodiment to two sides. This fastening member 9 is adapted to be inserted into the stiffening profile 3, head 9*b* foremost, from the side averted from the forming surface, through an opening 10 in the form of an oblong hole in the stiffening profile 3, and to be anchored to the latter with its head 9*b* in the manner to be seen in FIGS. 3 and 5. The fastening member 3 has at the end averted from the head 9*b* a counter-stop yet to be described for anchorage to the U-shaped device 1.

The fastening member 9 has a hammerhead 9*b* for anchoring the device 1 to a stiffening profile 3, in the one position of orientation the hammerhead 9*b* being adapted to be inserted through the oblong hole 10 in the cross web 3*b* of the stiffening profile 3. In a position rotated by 90°, the hammerhead 9*b* in the illustrated embodiment engages behind the edges of this oblong hole 10, as indicated by dashed lines in FIG. 2.

In comparing FIGS. 3 and 5 it is apparent that both U-arms 4 of the device 1 have extensions 7 stretching beyond the U-crosspiece 6 and that these extensions are shortened relative to the total length of the U-arms 4 in an identical manner and so as to be of identical size. Together with the U-crosspiece 6 the extensions 7 form an appropriately steplike shoulder 11 (see particularly FIGS. 3 and 4) and are situated beyond the neighboring region of the hole 8 for the fastening member 9.

According to FIG. 5 the extensions 7 can with their own longitudinal expanse directly engage the longitudinal sides 3*a* of the stiffening profile 3 as protection against torsion, when the U-arms 4 and the stiffening profiles 3 have a conforming direction of orientation. In a fitting position turned through 90° as in FIGS. 1 to 3, the shoulder 11 between U-crosspiece 6 and extension 7, or the shoulder 11 between the non-extended area of the U-arms and extension 7 of the U-arms, can serve to prevent torsion against the longitudinal side 3*a* of the stiffening profile 3, as is most clearly apparent in FIG. 3. These shoulders 11 are situated at that distance from the hole 8 for the fastening member 9 which the oblong hole 10 in the stiffening profile 3 has from the longitudinal webs 3*a* of the latter or from the end of the webs 3*a* adjacent to the cross web 3*b*. It is thereby achieved that the shoulders 11 produce the desired protection against torsion and come to rest against the profile 3 in the position in which the U-arms 4 of the device 1 are rotationally staggered by 90° relative to the longitudinal expanse of the profile 3.

The counter-stop already mentioned for the fastening member 9 is to be adapted to be braced against the U-crosspiece 6 of the device 1 and against the fastening member, in order to be able to urge the device 1 firmly against the profile 3 and to render the means protecting against torsion operative. It is of advantage if this counter-stop engages the shank 9*a* of the fastening member in a releasable manner. In the illustrated embodiment it is contemplated for this purpose that a transverse slit 9*c* through the shank 9*a* of the fastening member 9 at the end thereof averted from the head 9*b* is provided as a counter-stop, and that a wedge 12 fitting and being adapted to be inserted into this transverse slit 9*c* is provided as the counter-stop proper. In the position of use the transverse slit 9*c* extends somewhat into the hole 8 in the crosspiece 6 of the device 1. It is thereby ensured that as the wedge 12 is driven in, the narrow side thereof facing the U-crosspiece 6 comes to rest against the U-crosspiece 6 and with the opposite narrow side can exert the desired pull on the shank 9*a*.

In order that the device 1 does not become too large in size and that the lever arms applied to the profiles 3 by the device are not too great, the transverse slit 9*c* in the illustrated embodiment is disposed between the U-arms 4 and the U-arms 4 of the device 1 have openings 13 at the level of the transverse slit 9*c* for the anchoring wedge 12. These openings also extend so far towards the formwork that the U-crosspiece 6 has its surface averted from the forming surface lying inside the clearance of these openings 13, so that the wedge 12 comes to rest against this surface of the U-crosspiece 6.

It would also be conceivable that the wedge comes to rest against the corresponding boundaries of the openings 13, particularly if the slit 9*c* were not to extend into the hole 8 or beyond it.

It is evident by reference to FIG. 2 that the cross section of the transverse slit 9*c* for the wedge 12 is arranged on the shank 9*a* of the fastening member 9 so as to be turned through approximately 45° relative to the hammerhead 9*b* of the latter. The openings 13 in the U-arms 4 extend laterally in such a way that the wedge 12 passes at an angle from one arm 4, through the anchoring slit 9*c*, to the other arm 4 and opening 13 thereof. The wedge can therefore be arranged so as to pass from top to bottom at an angle in both possible orientations of the device 1, this making fitting easier, because initial insertion of the wedge is aided by gravity. Furthermore in this way the position of use is also sustained and secured better by gravity and a wedge 12 is prevented from unintentionally dropping out. In addition, a retaining pin 14 may be provided at the narrow end of the wedge 12.

The openings 13 extend laterally in the longitudinal orientation of the U-arms 4 to such an extent that the wedge 12 can be inserted from both sides, at an angle to the surface of the U-arms 4, in two positions displaced 90° from each other, in order not to have to pay any attention to the position of the transverse slit 9*c* when the fastening member 9 is inserted beforehand. Instead of correspondingly enlarged recesses or openings 13, several openings 13 side by side could also be provided in order to enable these two angular positions of the wedge 12.

In the illustrated embodiment the fastening locations 5 take the form of recesses or holes and are arranged on the U-arms 4 of the device 1, in spaced relationship to the openings 13 for the anchoring wedge 12. FIG. 1 makes it clear that a fastening location 5 is provided on each U-arm 4 and both fastening locations 5 are of the same shape, correspond in position, and take the form of e.g. bores for a bolt also fitting through corresponding bores 15 in the adjustable prop which, in turn, can be fitted inbetween the two U-arms 4. Therefore the coupling area and corresponding fastening location 15 of this adjustable prop 2 or of any other accessory part can be pushed between the U-arms 4 and anchored there using a bolt which extends through all the fastening locations 5 and 15. The adjustable prop can then absorb or transfer forces and moments which can be conducted by the device 1 into the profiles 3 in a favourable manner, without any danger of rotation or deflection. Conversely, forces coming from the profiles 3 and formwork panels can thus be transferred by way of the device 1 to such an adjustable prop 2 or the like.

Although other solutions are also possible, the illustrated embodiment contemplates that the extensions 7 of the U-arms 4 are integral therewith. The U-crosspiece 6 of the device 1 is fitted and welded between the U-arms 4 and extensions 7 thereof. The surface of the U-crosspiece resting against the web 3*b* of the stiffening profile 3 in the position of use is preferably approximately flush with —or according to FIG. 4 juts out slightly from—the non-extended area of the U-arms 4.

In the illustrated embodiment the hole 8 for the fastening member 9 is a bore, which can be made particularly simply.

FIG. 1 illustrates that the bolt-like fastening member 9 has between its shank 9*a* of cross section and the angular surfaces arranged in a roof-shaped manner on the underside of its head 9*b* a square area 9*d* as protection against torsion, the square area 9*d* serving to engage the recess 10 in the cross web 3*b* of the stiffening profile 3. The angular surfaces on the head 9*b* as well as this square area 9*d* therefore stabilize the position of the fastening member 9—and thereby that of the wedge and also of the entire device 1 —to thus improve the transfer of forces and moments.

It is further apparent in FIG. 1 that the U-arms 4 of the device 1 may be slanted between their end faces 4*a* and their edges 4*b* averted from the crosspiece 6, the slants being beyond the openings 13 for the anchoring wedge 12 and the holes 5 for fastening accessory parts 2. Weight is thereby saved and inconvenient projection of the device 1 relative to the profiles 3 and accessory parts 2 is limited as far as possible.

The device 1 serves for connecting accessory parts 2 to formwork panels, compensating members or suchlike formwork members having stiffening webs or stiffening profiles 3 on their side averted from the forming surface. The device 1 has an essentially U-shaped cross section, the U-arms 4 having fastening locations 5, preferably bores, for the accessory parts 2 such as booms, adjustable props, platform brackets or the like. In the position of use the U-crosspiece 6 butts and is drawn fast against a stiffening profile 3, particularly against a cross web 3*b* provided on the latter. At least one of the U-arms 4, preferably each U-arm 4, has an extension 7 passing over part of its length and beyond the U-crosspiece 6 on that side of the U-arms which faces the forming surface in the position of use. The extensions are provided as protection against torsion and are adapted to be placed against the longitudinal side faces 3*a* of the stiffening profile 3 and against the transitions from the rearward web 3*b* to the longitudinal side faces 3*a*. The U-crosspiece 6 of the device 1 has at least one recess or hole 8—possibly even one open at the edge—for a fastening member to engage, preferably for the shank 9*a* of a fastening member 9 to pass through. It is thereby possible for the device 1 to be anchored—in a torsion-proof position and in two orientations rotationally staggered by 90°—to a stiffening profile 3, so that the forces and moments encountered can be transferred well.

One configuration of significance to the invention is apparent primarily in FIG. 5 and also in FIG. 2. The, the extensions 7 are set somewhat at an angle to one another in comparison to the parallel U-arms 4, so as to be adapted well to the trapezoidal shape of the stiffening profile 3 and the corresponding slanting orientation of the cross section of the side webs 3*a* of the stiffening profile 3. The inside dimensions of these extensions 7 set somewhat at an angle to one anther correspond to the outside dimensions of the two longitudinal webs 3a of the stiffening profile 3.

It is also apparent in the Figures that in the position of use the narrower area of the wedge 12 traverses a U-arm and recess 13 thereof, but the wider area of the wedge passes by the outside of the opposite U-arm and end face thereof or is even supported against the latter. It is therefore not necessary for the wedge to traverse both recesses 13 simultaneously, but only one of them selectively.

I claim:

1. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including first means for urging said joining element and the first formwork component towards one another and second means for establishing a connection with said joining element, and at least one of said first portions being provided with connecting means for establishing a connection with the second formwork component, said fastening element comprising a shaft and said first means including a head on said shaft for abutment with the first formwork component so as to urge the latter towards said joining element, said head projecting radially outward of said shaft and being hammer-shaped so that said head can be passed through a slot in the first formwork component when said head has a first orientation and can engage the first formwork component behind the slot when said head is rotated from the first orientation to a second orientation, and said second means being spaced from said head.

2. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including first means for urging said joining element and the first formwork component towards one another and second means for establishing a connection with said joining element, and at least one of said first portions being provided with connecting means for establishing a connection with the second formwork component, said crosspiece being provided with receiving means for said fastening element.

3. The device of claim 2, wherein said fastening element comprises a shaft and said first means includes a head on said shaft for abutment with the first formwork component so as to urge the latter towards said joining element, said head projecting radially outward of said shaft, and said second means being spaced from said head.

4. The device of claim 2, wherein said second portions are spaced from said receiving means.

5. The device of claim 2, wherein each of said second portions has a shoulder for abutment with the first formwork component in said second relative orientation.

6. The device of claim 2, wherein each of said second portions is substantially in register with the respective first portion.

7. The device of claim 6, wherein each of said second portions constitutes an extension of the respective first portion.

8. The device of claim 2, wherein said crosspiece constitutes an abutment for the first selected formwork component.

9. The device of claim 2, wherein said shoulder is step-shaped.

10. The device of claim 2, wherein said connecting means comprises a recess.

11. The device of claim 2, wherein said connecting means comprises an opening.

12. The device of claim 2, wherein each of said first portions is provided with connecting means for establishing a connection with the second formwork component.

13. The device of claim 12, wherein the respective connecting means are substantially mirror-symmetrical about a plane located essentially midway between said first portions.

14. The device of claim 2, wherein each of said first portions is integral with the respective second portion.

15. The device of claim 2, wherein said crosspiece is welded to said legs.

16. The device of claim 2, wherein said receiving means includes a bore.

17. The device of claim 2, wherein said first portions are substantially parallel to one another.

18. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including first means for urging said joining element and the first formwork component towards one another and second means for establishing a connection with said joining element, and at least one of said first portions being provided with connecting means for establishing a connection with the second formwork component, the first formwork component including a stiffener having a pair of spaced arms and a transverse element connecting the arms to one another, the transverse element having first receiving means for said fastening element, and the first receiving means being spaced from each of the arms by a predetermined distance as considered in a direction from one of the arms to the other, said crosspiece having second receiving means for said fastening element, and said second receiving means being spaced from said shoulder by said predetermined distance as considered in a direction parallel to said legs and said crosspiece so as to permit alignment of the first receiving means and said second receiving means when said shoulder abuts the first formwork component.

19. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including first means for urging said joining element and the first formwork component towards one another and second means for establishing a connection with said joining element, and at least one of said first portions being provided with connecting means for establishing a connection with the second formwork component; and a locking element arranged to bear against said fastening element and against said joining element so as to lock said fastening element to said joining element.

20. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including first means for urging said joining element and the first formwork component towards one another and second means for establishing a connection with said joining element, said second means comprising a slit, and at least one of said first portions being provided with connecting means for establishing a connection with the second formwork component; and a locking element for releasably locking said fastening element to said joining element, said locking element comprising a wedge receivable in said slit.

21. The device of claim 20, wherein said crosspiece comprises receiving means for said fastening element and said slit extends into said receiving means when said fastening element urges the first formwork component and said joining element towards one another.

22. The device of claim 20, wherein said slit is disposed between said first portions when said fastening element urges the first formwork component and said joining element towards one another and at least one of said first portions is provided with a cutout for said wedge.

23. The device of claim 22, wherein said slit is situated at a predetermined level when said fastening element urges the first formwork component and said joining element towards one another and said cutout is disposed at least approximately at said predetermined level.

24. The device of claim 20, wherein said fastening element comprises a shaft and said first means includes a head on said shaft, said head being elongated and hammer-shaped so that said head can be passed through a slot in the first formwork component when said head has a first orientation and can engage the first formwork component behind the slot when said head is rotated from the first orientation to a second orientation, and said slit being provided in said shaft and disposed in a plane which is inclined with respect to the direction of elongation of said head.

25. The device of claim 23, wherein said plane and said direction define an angle of about 45 degrees.

26. The device of claim 20, wherein said slit is disposed between said first portions when said fastening element urges the first formwork component and said joining element towards one another and at least a selected one of said first portions is provided with a cutout for said wedge, said cutout being designed so that said wedge can traverse said selected first portion when said fastening element urges the first formwork component and said joining element towards one another and said wedge is received in said slit so as to extend along a direction which is inclined to said selected first portion.

27. The device of claim 20, wherein said slit is disposed between said first portions when said fastening element urges the first formwork component and said joining element towards one another and said first portions are provided with cutouts for said wedge, the number of cutouts or the sizes of said cutouts being such that said wedge can traverse at least one of said first portions when said fastening element urges the first formwork component and said joining element towards one another and said wedge is received in said slit so as to extend along either of two directions which are oppositely inclined to said first portions.

28. The device of claim 27, wherein said directions define an angle of about 90 degrees.

29. The device of claim 20, wherein said slit is disposed between said first portions when said fastening element urges the first formwork component and said joining element towards one another and said one first portion is provided with a cutout for said wedge, said cutout being spaced from said connecting means.

30. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation; and a fastening element for securing the joining element to the first formwork component, said fastening element including a shaft, first means for urging said joining element and the first formwork component towards one another and second means for establishing a connection with said joining element, and said first means including a head carried by said shaft, said fastening element further comprising a locking member for engagement in a slot of the first formwork component so as to prevent rotation of said fastening element, and said locking member being mounted on said shaft adjacent to said head, at least one of said first portions being provided with connecting means for establishing a connection with the second formwork component.

31. The device of claim 30, wherein said locking member is square or rectangular.

32. The device of claim 31, wherein said shaft is circular.

33. A device for connecting first and second formwork components to one another, comprising a joining element which includes a pair of spaced legs each having a first portion and a second portion, and a crosspiece connecting said legs to one another, said crosspiece being arranged such that said first portions project beyond a first side of said crosspiece and said second portions project beyond an opposite second side of of said crosspiece to thereby permit said second portions to embrace part of the first formwork component and prevent relative rotation of the first formwork component and said joining element when the first formwork component and said joining element have a first relative orientation, at least one of said second portions having a shoulder for abutment with the first formwork component in a second relative orientation of the first formwork component and said joining element so as to prevent relative rotation of the first formwork component and said joining element when the first formwork component and said joining element have said second relative orientation, each of said first portions having a first end face directed towards said second portions and a second end face directed away from said second portions, and each of said first portions being provided with a chamfer between the respective end faces; a fastening element for securing the joining element to the first formwork component, said fastening element including first means for urging said joining element and the first formwork component towards one another and second means for establishing a connection with said joining element, said second means comprising a slit disposed between said first portions when said fastening element urges the first formwork component and said joining element towards one another, at least one of said first portions being provided with connecting means for establishing a connection with the second formwork component; and a locking element receivable in said slit to lock said fastening element to said joining element, each of said first portions being provided with cutouts for said locking element and with connecting means for establishing a connection to the second formwork component, and said chamfers being spaced from said cutouts and said connecting means.

* * * * *